US009522719B1

(12) United States Patent
Yonover

(10) Patent No.: US 9,522,719 B1
(45) Date of Patent: Dec. 20, 2016

(54) WATERCRAFT DRIVEN BY A RECIPROCATING FIN

(71) Applicant: Robert Yonover, Honolulu, HI (US)

(72) Inventor: Robert Yonover, Honolulu, HI (US)

( * ) Notice: Subject to any disclaimer, the term of this patent is extended or adjusted under 35 U.S.C. 154(b) by 0 days.

(21) Appl. No.: 14/803,822

(22) Filed: Jul. 20, 2015

(51) Int. Cl.
*B63H 1/30* (2006.01)
*B63H 16/08* (2006.01)
*B63H 1/36* (2006.01)

(52) U.S. Cl.
CPC ..... *B63H 16/14* (2013.01); *B63H 1/36* (2013.01)

(58) Field of Classification Search
CPC ..... B63H 1/36; B63H 2001/30; B63H 16/00; B63H 16/08; B63H 16/12; B63H 16/14; B63H 16/20; B63H 2016/00; B63H 2016/08; B63H 2016/20; B63H 2016/202; B63H 2016/205
USPC ..... 440/13–15, 21, 26, 29, 30, 31, 32, 95
See application file for complete search history.

(56) References Cited

U.S. PATENT DOCUMENTS 2,696,797 A * 12/1954 Whidden ..... B63H 16/00 440/14
3,855,957 A * 12/1974 Gross ..... B63H 16/12 440/15
3,987,747 A * 10/1976 Locher ..... B60F 3/0084 440/12.53
4,345,903 A * 8/1982 Laser ..... B63B 35/73 114/140
4,642,056 A * 2/1987 Keivanjah ..... B63H 1/36 416/66
5,316,508 A * 5/1994 Landucci ..... B63H 16/14 114/144 R
5,443,405 A * 8/1995 Zeyger ..... B63H 21/175 440/12
5,544,906 A * 8/1996 Clapper ..... B62K 3/005 280/269
5,547,406 A * 8/1996 White ..... B63H 16/14 114/61.1
5,803,774 A * 9/1998 White ..... B63H 21/175 114/61.12
6,033,276 A * 3/2000 Han ..... B63C 11/46 114/315
6,079,344 A * 6/2000 Wang ..... B63H 1/36 114/39.21
6,135,830 A * 10/2000 Elefant ..... B63H 21/175 440/12
6,267,631 B1 * 7/2001 Anderson ..... B63H 21/175 440/12
6,595,813 B1 * 7/2003 Lekhtman ..... B63H 1/32 440/21
6,843,691 B1 * 1/2005 Jelten ..... B63H 16/12 440/15
8,986,057 B2 * 3/2015 Catarina ..... B63B 1/12 440/21

(Continued)

*Primary Examiner* — Daniel V Venne
(74) *Attorney, Agent, or Firm* — Shlesinger, Arkwright & Garvey LLP

(57) ABSTRACT

A watercraft for moving along a direction of movement on water includes a flexible fin with a front face and a rear face to be disposed in the water; and one end of the fin is movable along a line in a reciprocating motion along a direction transverse to the front and rear faces and the direction of movement of the watercraft, causing an opposite free end of the fin to flex back and forth in the water to propel the watercraft in the direction of movement.

24 Claims, 13 Drawing Sheets

(56) References Cited

U.S. PATENT DOCUMENTS

| | | | | |
|---|---|---|---|---|
| 2004/0087225 | A1* | 5/2004 | Norman | B63B 7/04<br>440/28 |
| 2013/0157529 | A1* | 6/2013 | Santa Catarina | B63B 1/12<br>440/21 |
| 2015/0314848 | A1* | 11/2015 | Lyons | B63H 16/14<br>440/30 |

* cited by examiner 126
124
130
131
134
128
136
26
146
144
132

WATERCRAFT DRIVEN BY A RECIPROCATING FIN

FIELD OF THE INVENTION

The present invention is generally directed to a watercraft driven by a reciprocating fin and in particular to a watercraft where pedal power is used to drive the fin in the water in a reciprocating motion transverse to the direction of travel.

SUMMARY OF THE INVENTION

The present invention provides a watercraft for moving along a direction of movement on water, comprising a flexible fin with a front face and a rear face to be disposed in the water; and one end of the fin is movable along a line in a reciprocating motion along a direction transverse to the front and rear faces and the direction of movement of the watercraft, causing an opposite free end of the fin to flex back and forth in the water to propel the watercraft in the direction of movement.

DETAILED DESCRIPTION OF THE INVENTION

Figure 1:
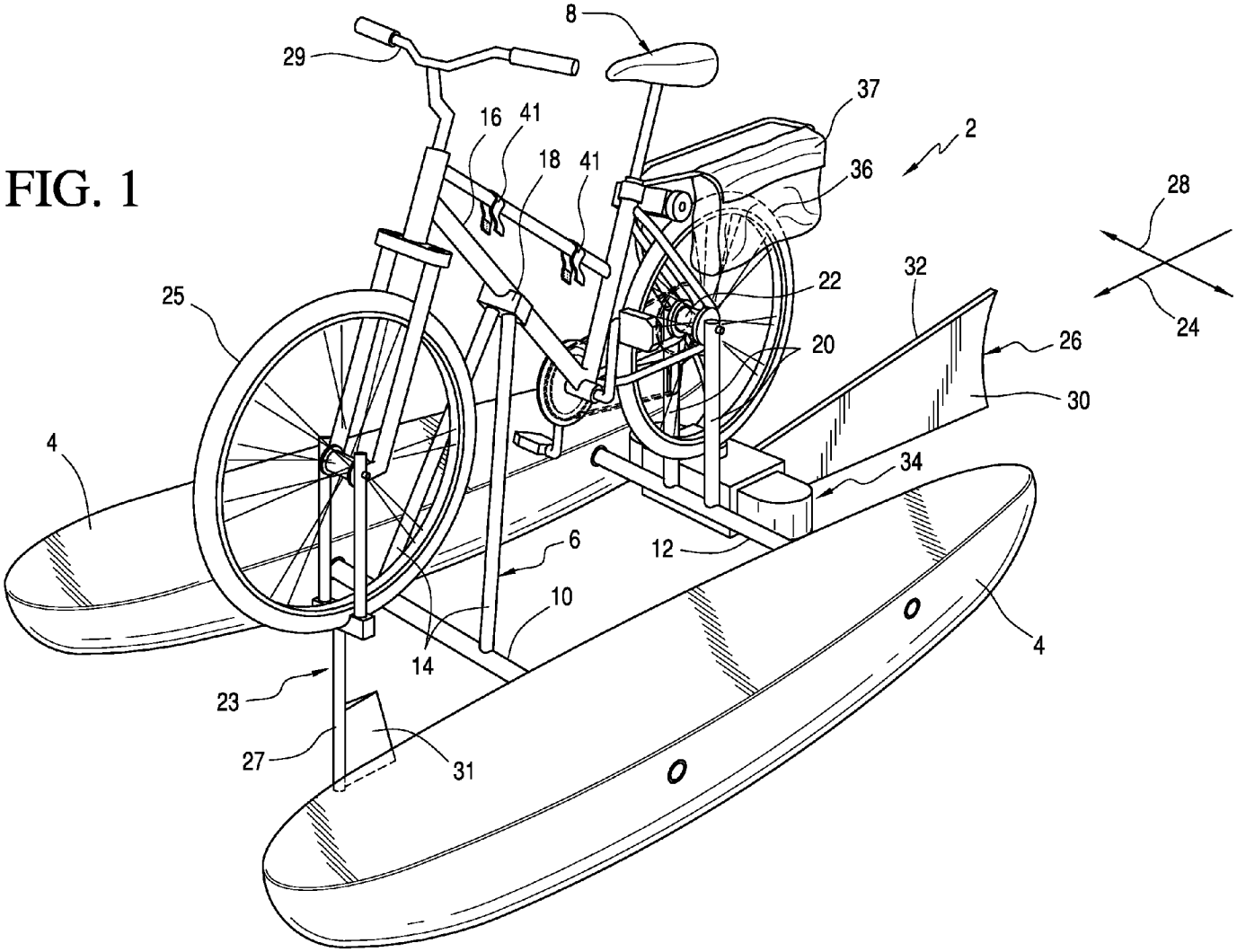
FIG. 1 is a perspective view of a watercraft propelled by pedaling to drive a flexible fin in a reciprocating, side-to-side, back-and-forth motion.

A watercraft 2 made in accordance with the present invention is disclosed in FIG. 1. The watercraft 2 includes a pair of floats 4 for floating on water. The floats 4 may be inflatable so that they may be deflated to occupy a smaller volume for easy transport and storage. A support structure 6 is operably attached to the floats 4 so that the floats are spaced apart from each other for a stable configuration and to provide a base to which a bicycle 8 can be attached.

The support structure 6 includes a horizontal front member 10 and a horizontal rear member 12 operably supported by the floats 4. Upwardly extending members 14 are operably attached to the front member 10 to operably support the frame 16 of the bicycle 8 through a cradle 18. Vertical members 20 are operably attached to the rear member 12 to provide support for the rear axle 22 of the bicycle 8.

A rudder 23 is operably attached to the front wheel 25 of the bicycle 8. A fork structure 27 is attached to the front axle of the front wheel 25 so that turning the handlebar 29 of the bicycle 8 is effective to turn a vane 31 attached to the yoke structure 27 to steer the watercraft 2 in the direction the handlebar 29 is turned. The yoke structure 27 fits snugly against the front wheel 25 for a rigid attachment.

The support structure 6 and the rudder 23 are advantageously detachable from the bicycle 8 and the floats 4 with standard means for easy transport and storage. The bicycle 8 can then be used alone on the ground. A bag 37 is provided to carry the parts of the watercraft 2, such as the inflatable floats 4 when deflated. Straps 41 may be used to carry the components of the support structure 6 when disassembled from the watercraft 2. By providing the support structure 6, the inflatable floats 4 and the converter 34 with ease of disassembly and assembly be carried by the bicycle 8, the user can advantageously use the bicycle 8 on the ground or over the water. A person of ordinary skill in the art will understand how to make the various components of the watercraft 2 to be readily broken down for transport on the ground with the bicycle 8 or readily assembled for use over water.

The watercraft 4 is propelled along a direction of movement 24 on the water by a flexible fin 26 that reciprocates along a direction 28 transverse to the direction of movement 24. The fin 26 includes substantially flat front and rear faces 30 and 32 that flex back and forth generally in the direction 28 to propel the watercraft 4 in the direction 24. The front and rear faces 30 and 32 taper from narrow to wide from the attachment end portion to the free end portion 33. The end portion 33 may be inwardly curved at the outer edge 35 to provide some channeling of water for stability. A rotary-to-linear motion converter 34 converts the rotary motion of the rear wheel 36 of the bicycle 8 to a linear reciprocating motion that drives the fin 26 in the side-to-side back-and-forth flexing motion. The front and rear faces 30 and 32 of the fin 26 are advantageously disposed substantially perpendicular to the horizontal plane represented by the water surface to present the maximum surface area to the water during the flexing movement of the fin 26.

Figure 2:
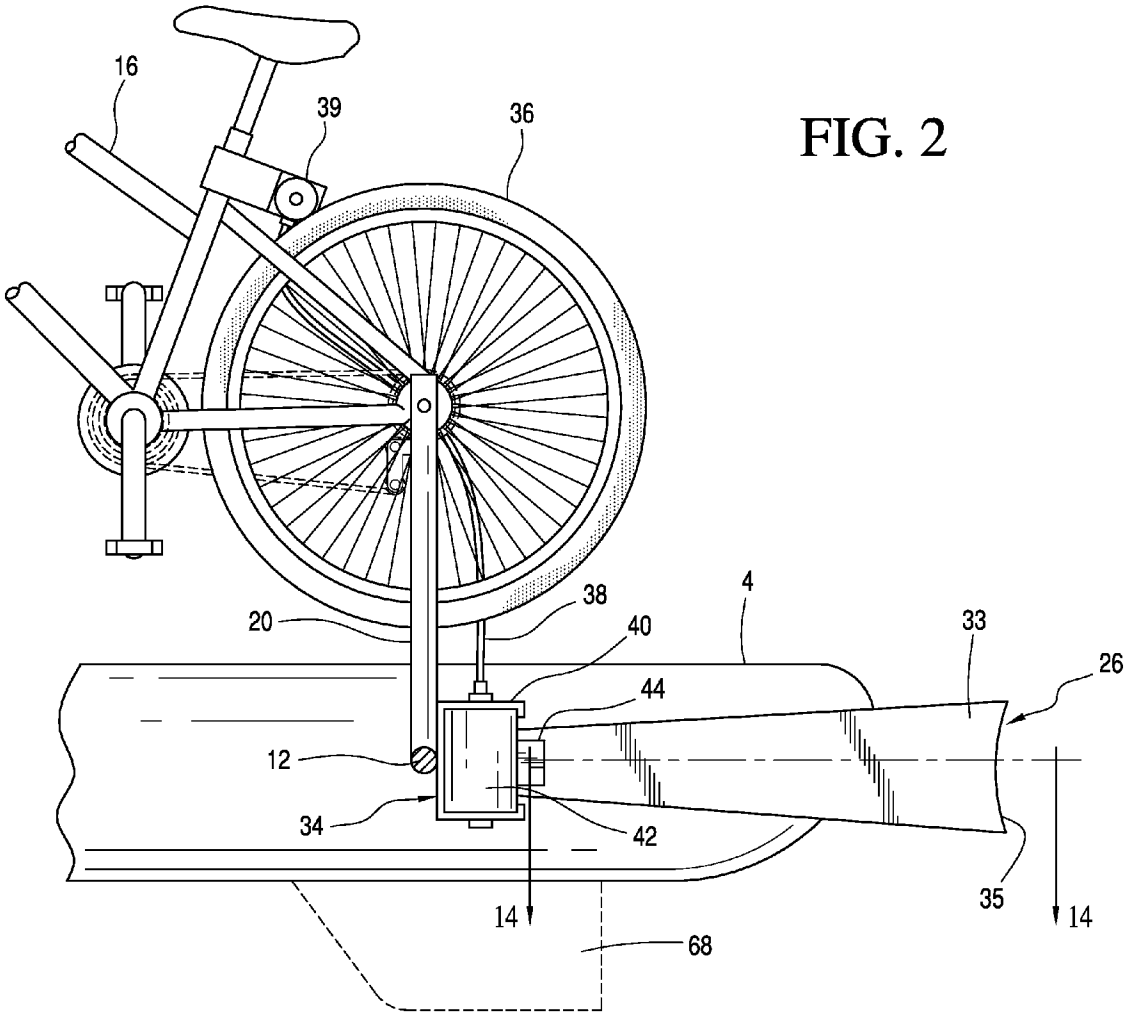
FIG. 2 is a side elevational view of the rear portion of the watercraft of FIG. 1, with portion shown in cross-section.

Referring to FIG. 2, a flexible shaft 38 rotated by a wheel 39 in driving contact with the rear wheel 36 provides rotary motion input to the converter 34. The wheel 39 is operably attached to the frame 16 of the bicycle 8. Reduction gears may be used to reduce the rotational speed of the flexible shaft 38. The converter 34 includes a guide 40 operably attached to the rear member 12 and the vertical members 20. A housing 42 reciprocates in a sliding motion within the guide 40. Flanges 44 are rigidly attached to the housing 42 and the fin 26 so that the reciprocating motion of the housing 42 is transferred to the fin 26. A person of ordinary skill in the art will understand that a rigid shaft with appropriate universal joints for changing directions may also be used in place of the flexible shaft 38.

Figures 3, 4, 5:
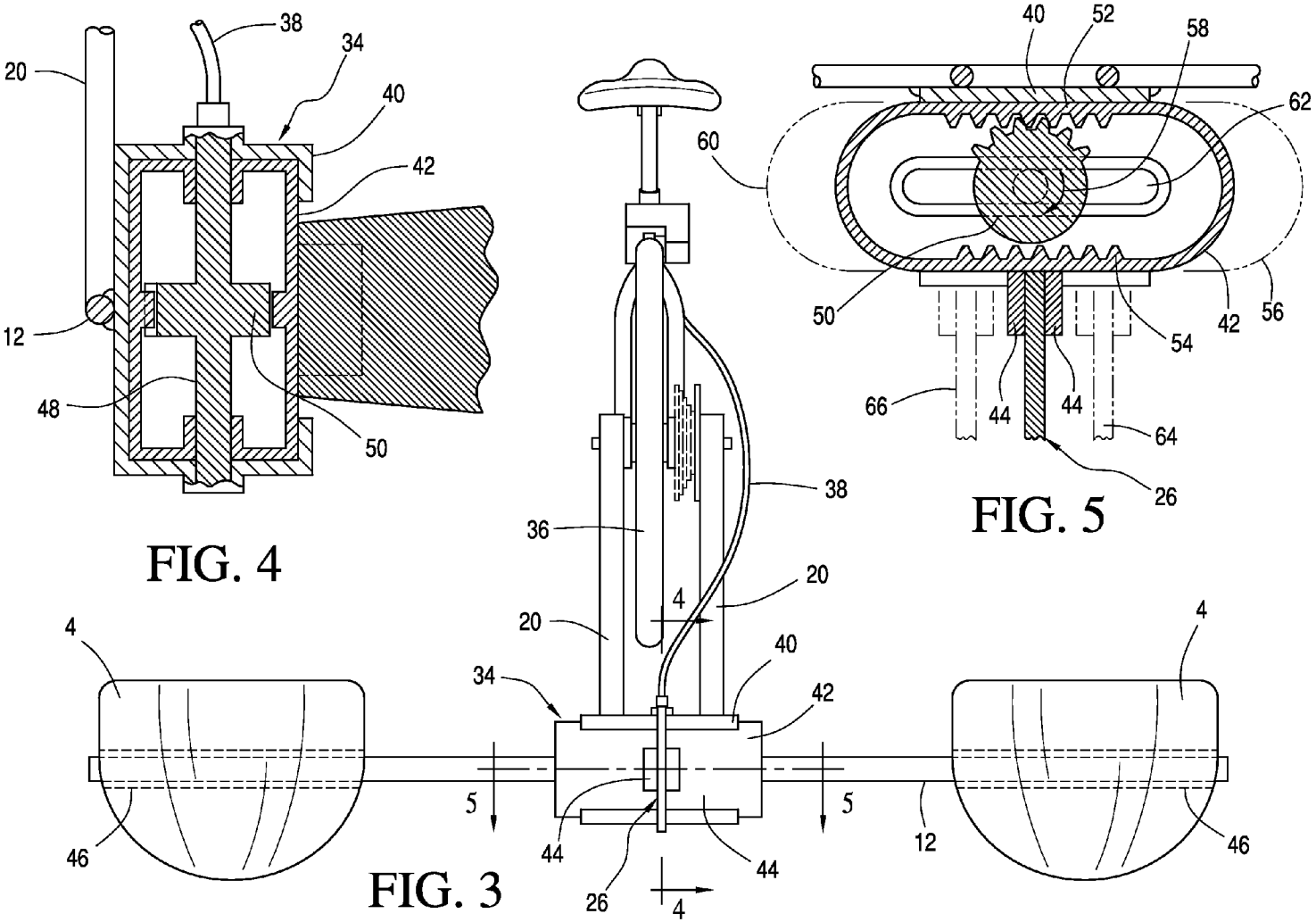
FIG. 3 is a rear elevational view of FIG. 1.
FIG. 4 is a cross-sectional view taken along line 4-4 in FIG. 3.
FIG. 5 is a cross-sectional view taken along line 5-5 in FIG. 3.

Referring to FIG. 3, the rear member 12 is disposed within pipe members 46 attached across the widths of the floats 4. The rear member 12 is removably attached to the floats 4 with standard means, such as cotter pins attached to the rear member 12 at opposite sides of the floats 4, for easy assembly and breakdown. Although not shown, the front member 10 is also similarly attached to the floats 4.

Referring to FIG. 4, the converter 34 includes a shaft 48 rotatably attached to the guide 40. The shaft 48 is driven by the flexible shaft 38. A partial gear 50 is operably attached to the shaft 48 such that rotation of the shaft 48 causes rotation of the partial gear 50. The housing 42 reciprocates in a sliding motion within the guide 40.

Referring to FIG. 5, the housing 42 includes opposed rack gears 52 and 54 that alternately engage with the partial gear 50 as the shaft 48 is rotated. When the partial gear is in engagement with the rack gear 52, the housing 42 moves toward the right to a position 56 shown in dashed lines, with shaft 48 and the partial gear 50 rotating in a clockwise direction 58. When the housing 42 reaches the position 56, the partial gear 50 will be in engagement with the opposite rack gear 54 to move the housing 50 to an opposite direction 60 as shown in dashed line. When the housing reaches the position 60, the housing then moves to the right to the position 56 and so on in a reciprocating motion between the positions 56 and 60 as the shaft 48 and the partial gear 50 continue to rotate. A slot 62 in the housing 42 allows for the reciprocating motion of the housing 42 in the guide 40.

Referring to FIG. 5, the fin 26, which is attached to the housing 42 by means of the flanges 44, which are in turn attached to the housing 42, is shown reciprocating between positions 64 and 66 shown in dashed lines. The reciprocating motion causes the fin 26 to flex back and forth, much like a fish tail or swimming flippers, to propel the watercraft forward. A stabilizing fin 68 (see FIG. 2) may be provided to the floats 4 to advantageously reduce any tendency by the watercraft to move side to side in reaction to the flexing motion of the fin 26.

Figure 6:
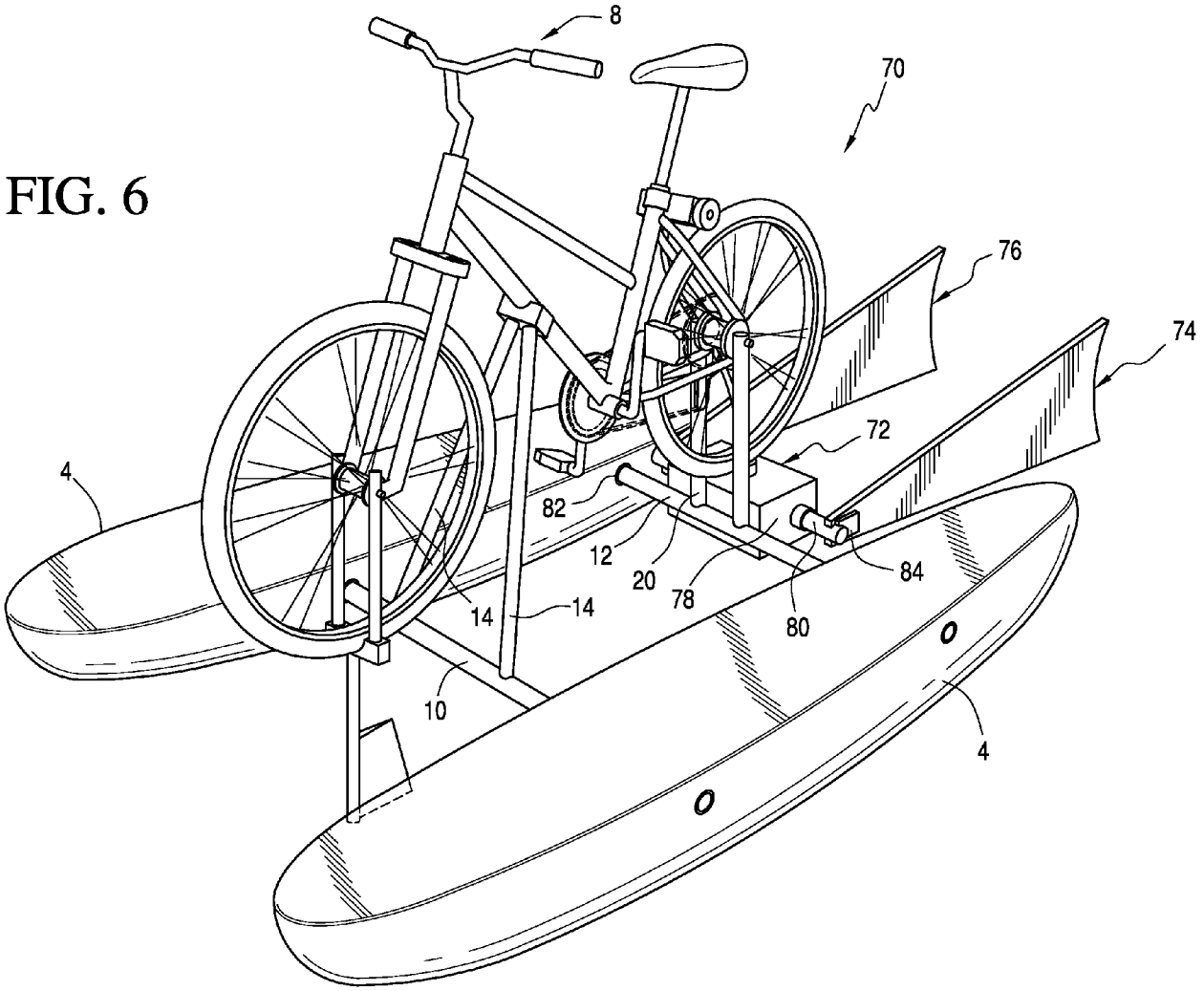
FIG. 6 is a perspective view of another embodiment of a watercraft propelled by pedaling to drive a pair of flexible fins in an opposing reciprocating, side-to-side, back-and-forth motion.
Figure 7:
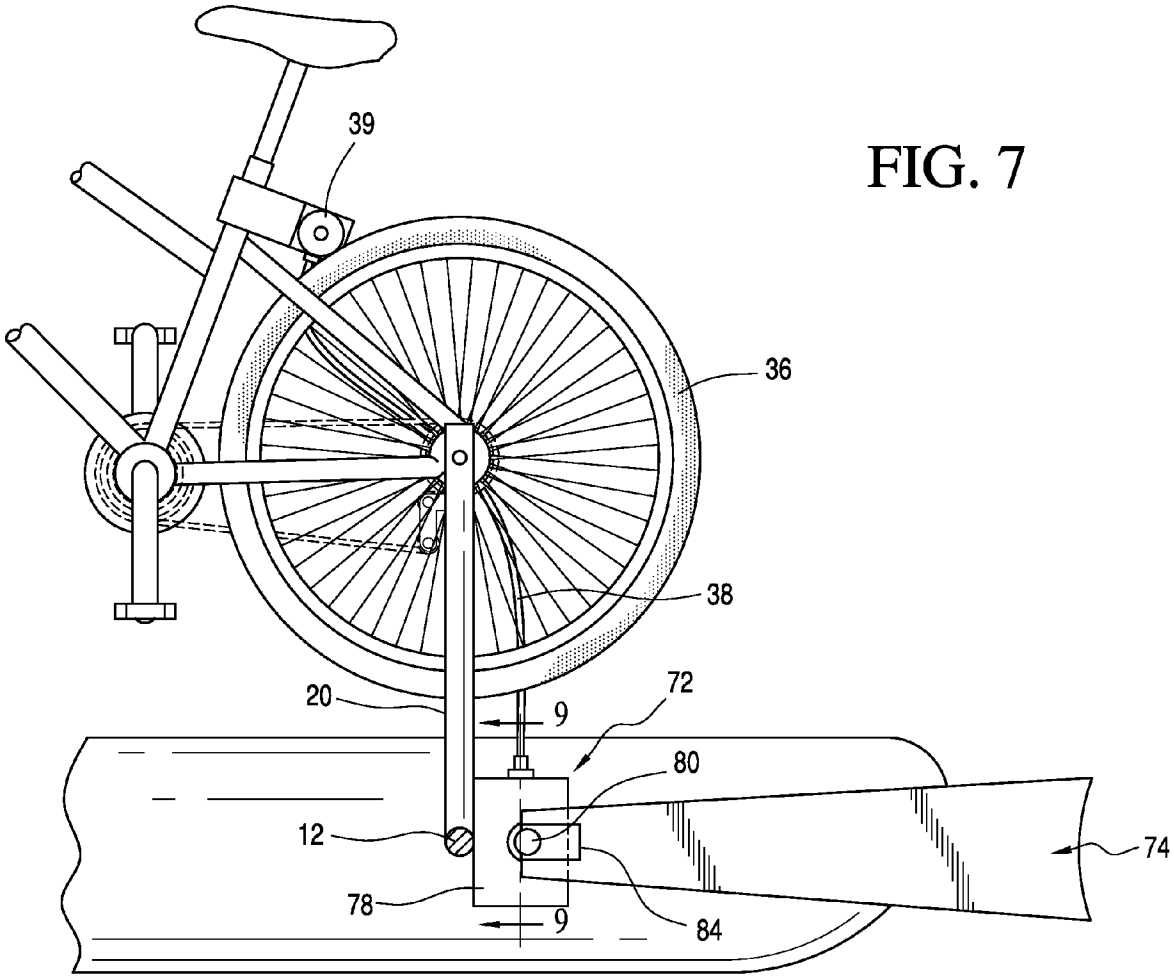
FIG. 7 is a side elevational view of the rear portion of the watercraft of FIG. 6, with portion shown in cross-section.

Referring to FIGS. 6 and 7, another embodiment of a watercraft 70 is 70 is disclosed. The watercraft 70 is the similar to the watercraft 4, except that another embodiment of a rotary-to-linear motion converter 72 with a double fin arrangement of fins 74 and 76 are provided. The fins 74 and 76 flex back and forth toward and away from each other. A housing 78 is operably attached to the rear member 12 and vertical members 20. Push rods 80 and 82 extend outside the housing 78 and are attached to respective fins 74 and 76 with flanges 84 attached to the push rods 80 and 82. The front and rear faces 30 and 32 of the fins 74 and 76 are advantageously disposed substantially perpendicular to the horizontal plane represented by the water surface to present the maximum surface area to the water during the flexing movement of the fins.

Figure 10:
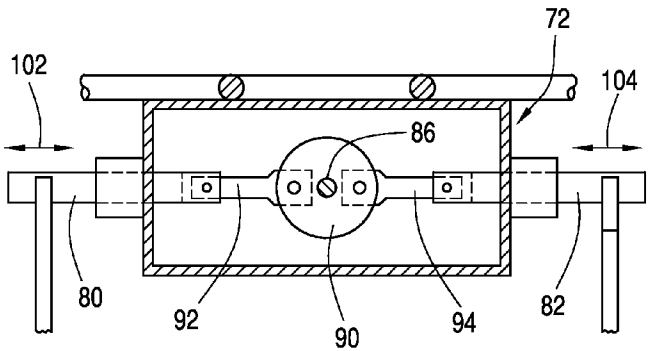
FIG. 10 is a cross-sectional view taken along line 10-10 in FIG. 8.
Figure 9:
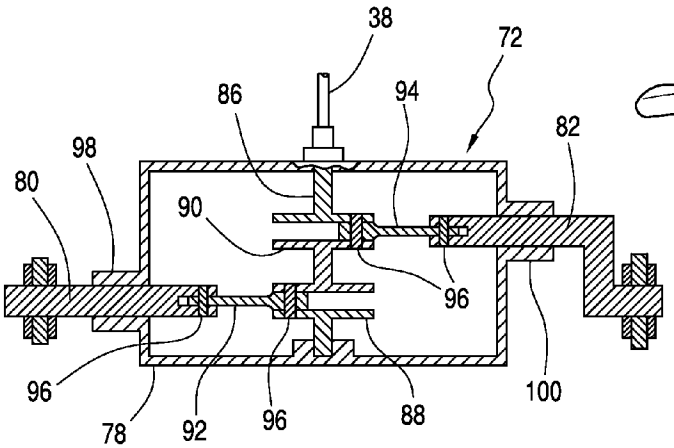
FIG. 9 is a cross-sectional view taken along line 9-9 in FIG. 7.
Figure 8:
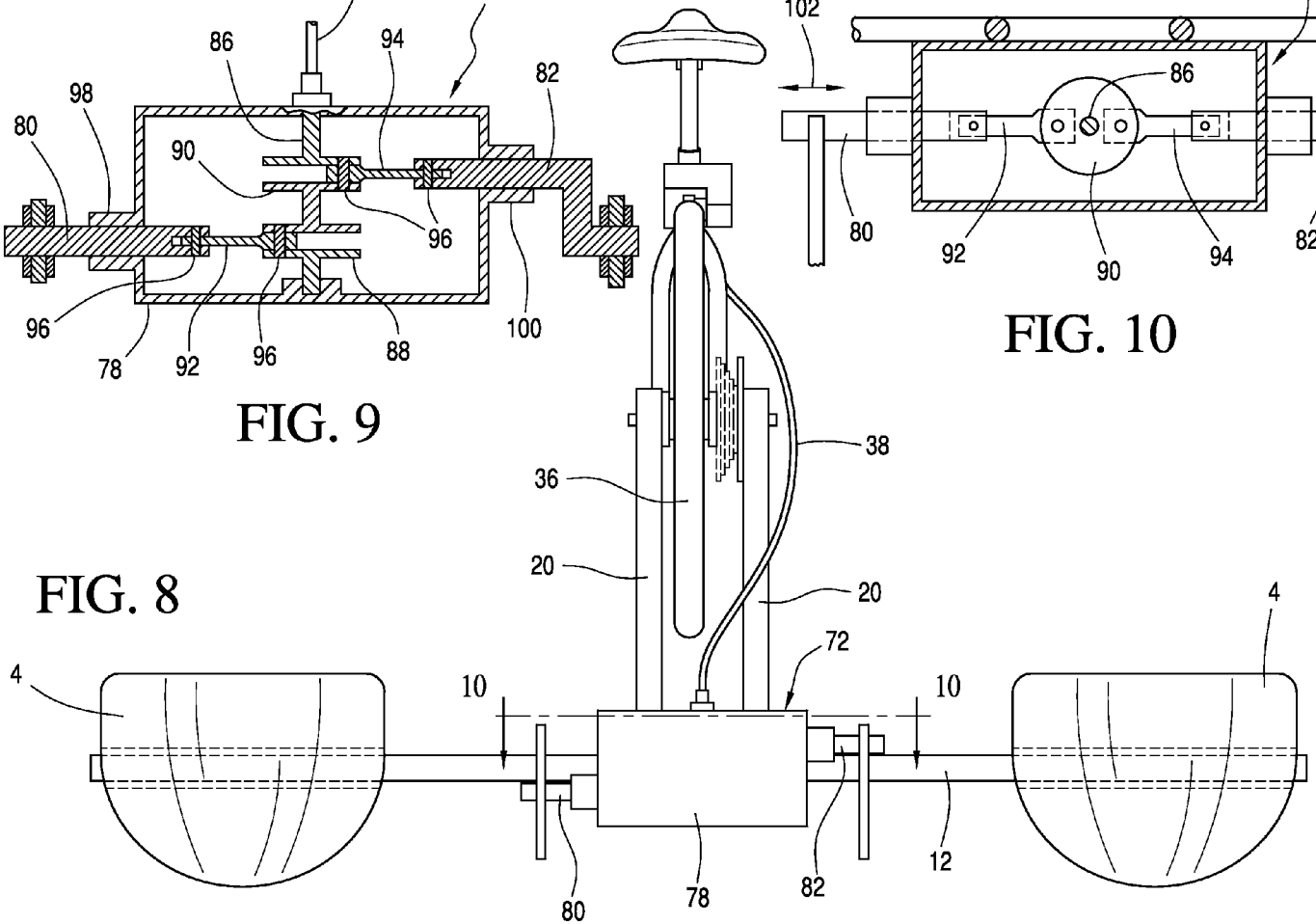
FIG. 8 is a rear elevational view of FIG. 7.

Referring to FIGS. 8, 9 and 10, the structure of the converter 72 is shown in greater detail. The converter 72 includes crankshaft 86 operably attached to the flexible shaft 38. The crankshaft 86 is rotatably supported by the housing 78. Cranks 88 and 90 are operably attached to the crankshaft 86 so that when the crankshaft 86 turns, the cranks 88 and 90 also turn. Connecting rods 92 and 94 are pivotably connected to respective cranks 88 and 90 and respective push rods 80 and 82. Pins 96 provide the pivotable connections. The push rods 80 and 82 are slidably disposed in respective sleeves 98 and 100 so that the push rods 80 and 82 move in linear reciprocating motions 102 and 104 when the crankshaft 86 turns. At any one time, the motions 102 and 104 are always in opposite directions. When the push rod 80 is moving to the left, the push rod 82 is moving to the right; and when the push rod 80 is moving right, the push rod 82 is moving to the left. In this way, the fins 74 and 76 are either moving toward or away from each other. The opposed motions of the fins 74 and 76 advantageously reduce any tendency by the watercraft to move side to side in reaction to the flexing motion of the fins.

Figure 11:
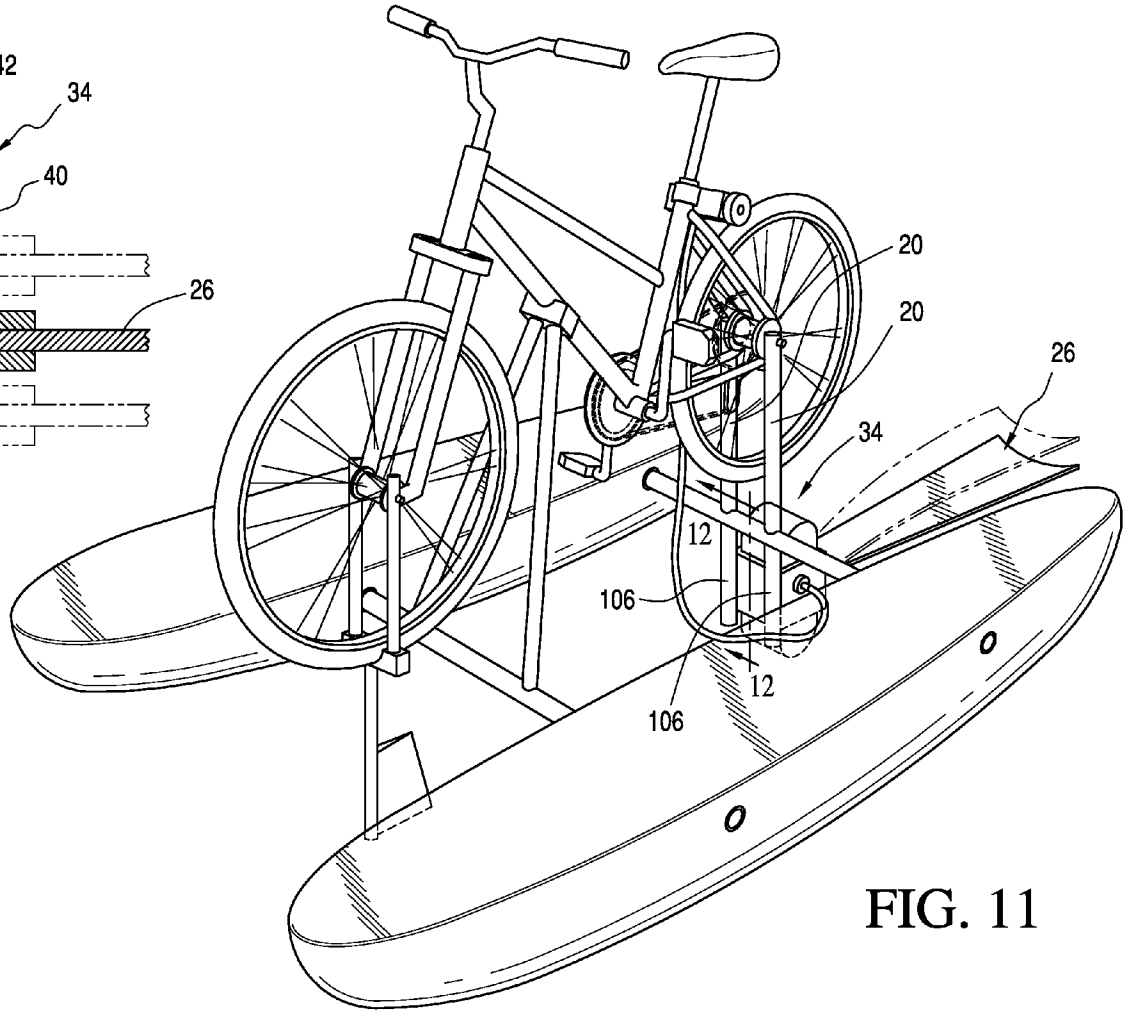
FIG. 11 is a perspective view of another embodiment of a watercraft propelled by pedaling to drive a flexible fin in a vertical reciprocating up-and-down, back-and-forth motion.
Figure 12:
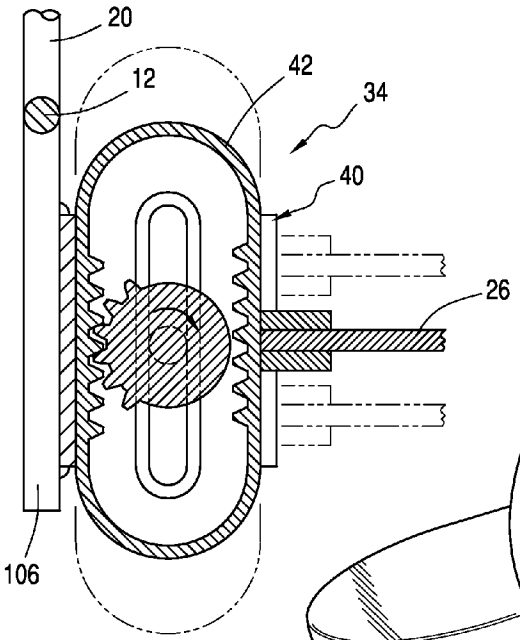
FIG. 12 is a cross-sectional view taken along line 12-12 in FIG. 11.

Referring to FIGS. 11 and 12, the converter 34 used for the watercraft 2 is turned 90° so that the fin 26 moves up and down instead of side-to-side. The vertical members 20 are provided with extensions 106 to which the guide 40 is attached to lower the position of the converter into the water, thereby keeping the fin 26 underwater within its range of up and down motion. In this embodiment, the front and rear faces 30 and 32 of the fin 26 are advantageously disposed substantially parallel to the horizontal plane represented by the water surface to present the maximum surface area to the water during the flexing movement of the fin 26.

Figure 13:
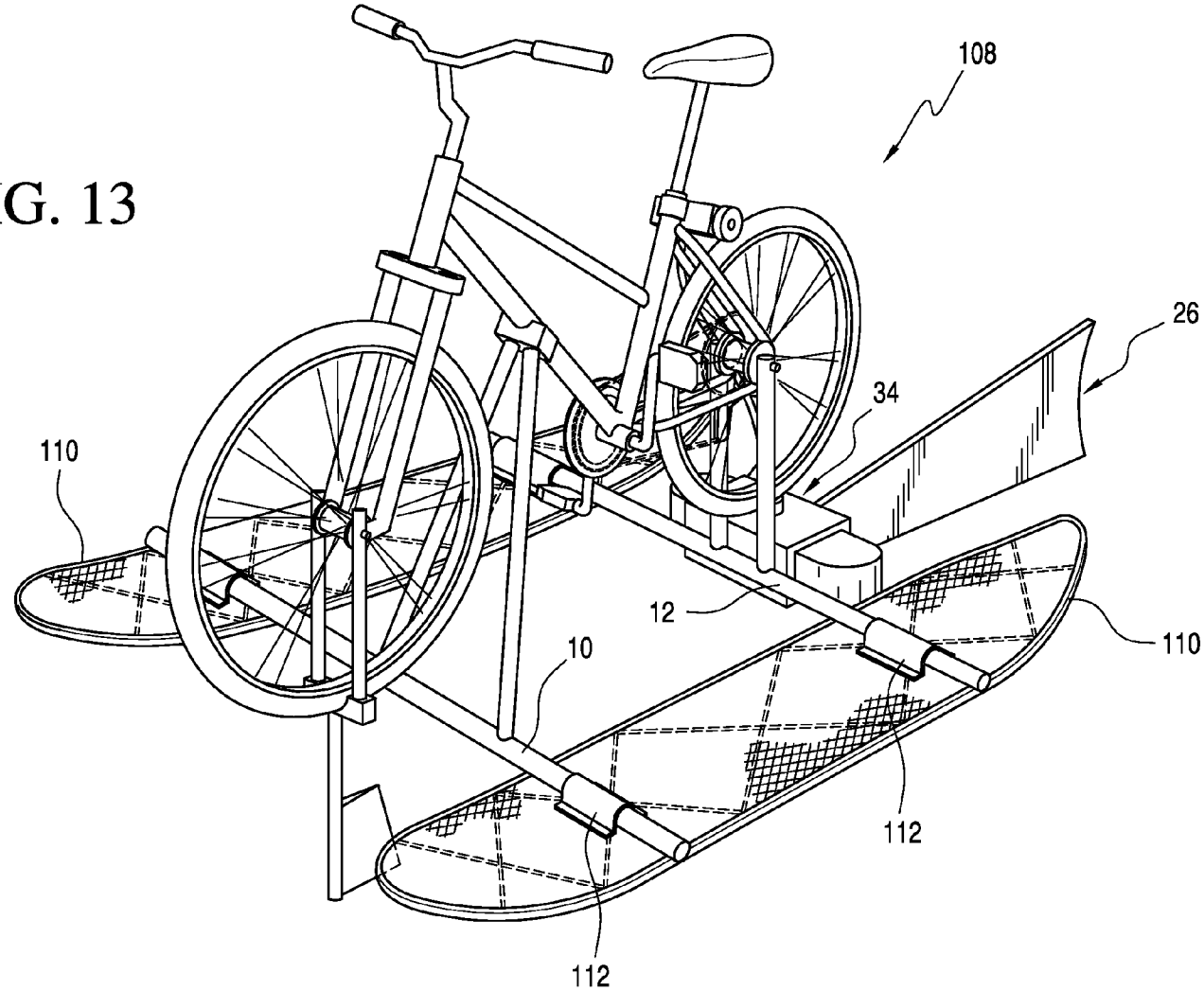
FIG. 13 is a perspective view of another embodiment of a watercraft propelled by pedaling to drive a flexible fin in a reciprocating side-to-side, back-and-forth motion, wherein the floats are made of inflatable paddleboard.

Referring to FIG. 13, another embodiment of a watercraft 108 is disclosed. The watercraft 108 is similar to the watercraft 2, except that the floats 4 are replaced with inflatable paddleboards 110, which are disclosed in U.S. Pat. No. 6,066,016, the entire disclosure of which is hereby incorporated herein by reference. The front and rear members 10 and 12 are removably attached to the paddleboards 110 within sleeves 112. The paddleboards 110 are deflatable for easy transport and storage.

Figure 14:
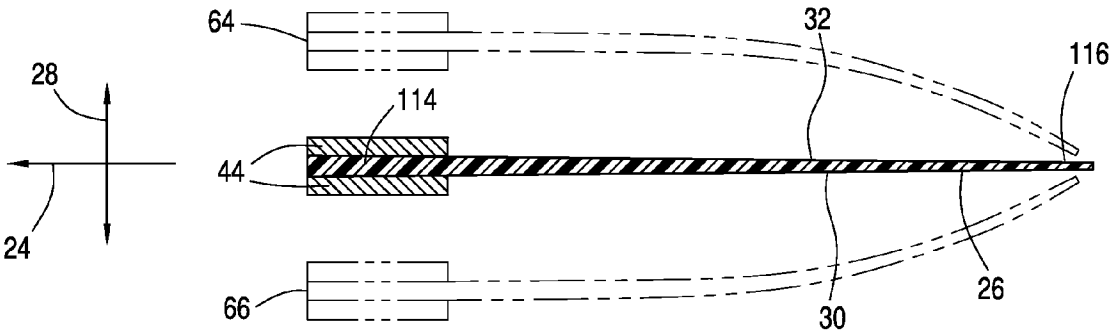
FIG. 14 is cross-sectional view taken along line 14-14 in FIG. 2, showing the flexing motion of the fin as it moves in a reciprocating side-to-side back-and-forth motion between two positions.

Referring to FIG. 14, the thickness of the fin 26 tapers from wide to narrow from the attachment end portion 114 to the terminal end portion 116. As the attachment end portion 114 reciprocates linearly in the direction 28 between the positions 64 and 66 shown in dashed lines, the fin 26 flexes as shown in dashed lines to propel the watercraft in the direction 24. The directions 24 and 28 are substantially transverse to each other. The tapered thickness of the fin 26 advantageously allows more flexing at the terminal end portion 116 than at portions near the attachment end portion 114. The front and rear faces 30 and 32 of the fin 26 are shown substantially perpendicular to the horizontal plane represented by the water surface to present the maximum surface area to the water during the flexing movement of the fin 26.

Figure 15:
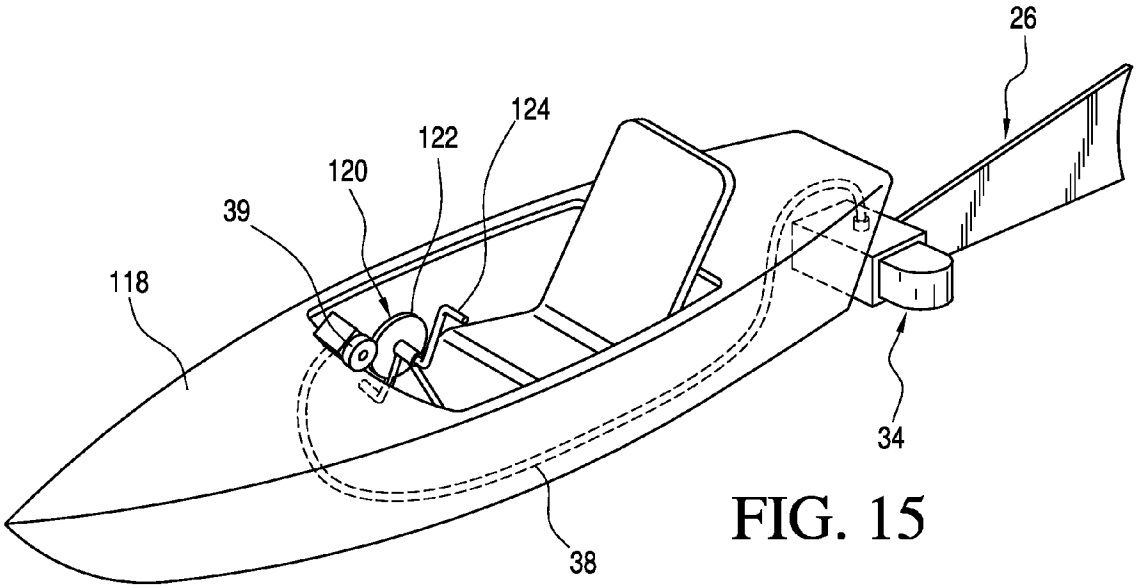
FIG. 15 is a perspective view of another embodiment of a watercraft propelled by pedaling to drive a flexible fin in a reciprocating side-to-side, back-and-forth motion.

Referring to FIG. 15, the pedaling motion and the rotary-to-linear motion converter 34 may be used in other types of watercrafts, such as a canoe, kayak or a flat-bottom boat 118. A crankset 120 including a crank wheel 120 and a pair of crank arms 124 driven by the user's feet or arms. The wheel 39 is operably driven by the crank wheel 120. The flexible shaft 38 is operably connected to the wheel 39 to drive the converter 34.

There are other ways of generating the side-to-side motion of the fin 26 from the rotary motion of the bicycle rear wheel 36.

Figure 17:
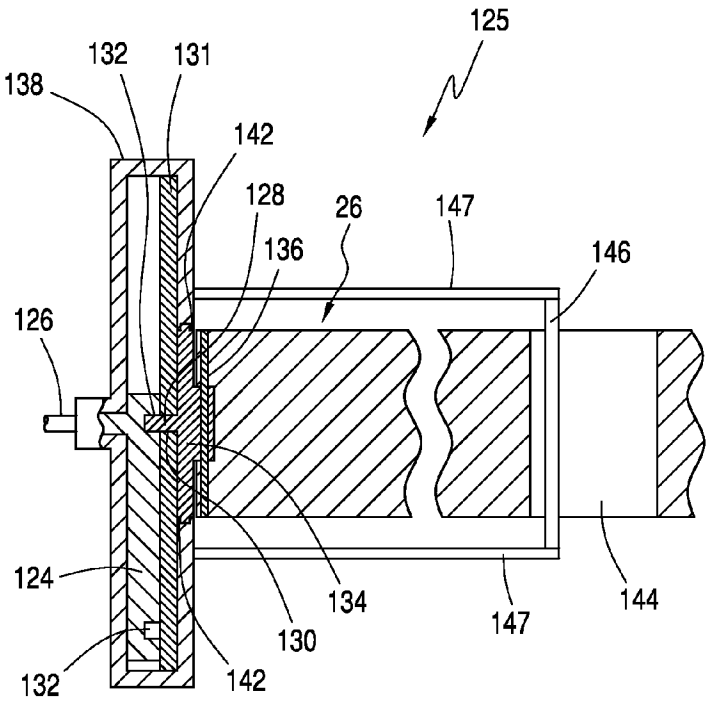
FIG. 17 is a cross-sectional view taken along line 17-17 in FIG. 16.
Figure 16:
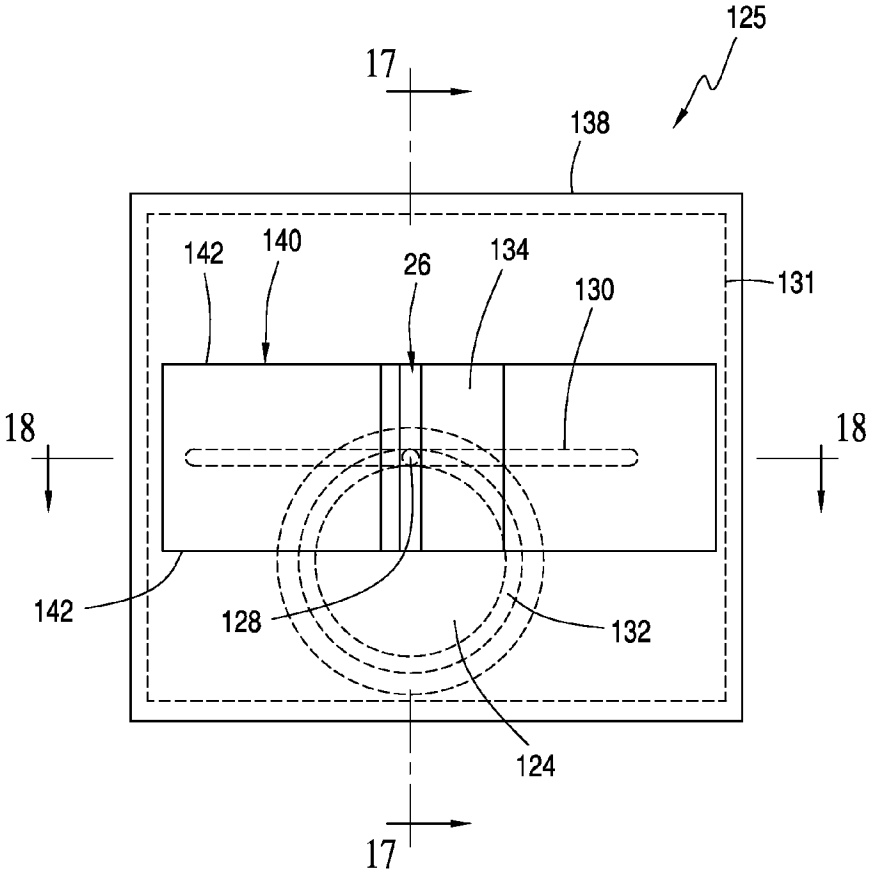
FIG. 16 is an elevational view of another embodiment of a rotary-to-linear motion converter.

Referring to FIGS. 16 and 17, a rotary-to-linear motion converter 125 includes a crankwheel 124 rotatable about a shaft 126 causes the fin 26 to move side-to-side, back-and-forth. A pin 128 operably attached to the fin 26 is captured within a longitudinal slot 130 in a member 131 and a circular slot 132. Rotation of the crankwheel 124 causes the pin 132 to traverse the longitudinal slot 130 and the circular slot 132, causing the fin 26 to move side-to-side in a back-and-forth manner. The pin 128 is rigidly attached to a member 134, which is then attached to the pin 26 in a rigid manner as shown, for example, in FIG. 5 with flanges 44 or with a pivot 136. A housing 138 provides support for the crankwheel 124 and the member 134. The housing also provides a guide 140 made up of opposing parallel edges 142 along which the member 134 slides from the action of the crankwheel 124. Tongue and groove structure between the opposing edges 142 and the corresponding edges of the member 134 may be provided to retain the sliding member 134 to the housing 138 while the member 134 slides back and forth along the edges 142. The edges 142 may be provided with the groove and the corresponding edges of the member 134 with the tongue. The housing 138 is operably attached to the support structure 6, such as the rear member 12 and the members 20 for a rigid connection.

Figures 18, 19, 20:
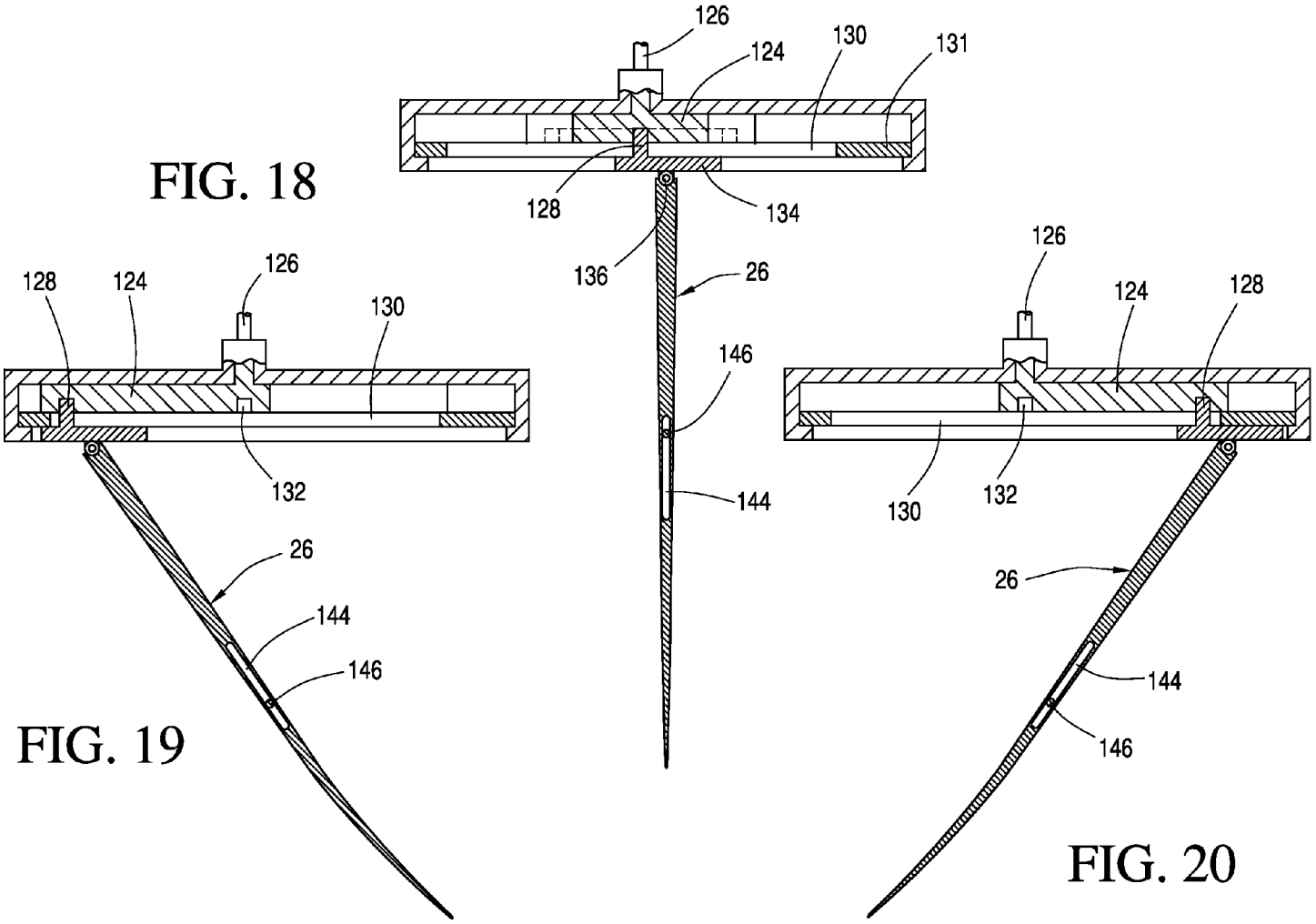
FIG. 18 is a cross-sectional view taken along line 18-18 in FIG. 16.
FIG. 19 shows the flexible fin just as it reaches the end of travel to the left from the center position of FIG. 18, with the outer portion of the fin flexing from the movement to the left.
FIG. 20 shows the flexible fin just as it reaches the end of travel to the right from the center position of FIG. 18, with the outer portion of the fin flexing from the movement to the right.

Referring to FIGS. 18-20, the side-to-side, back-and-forth reciprocating movement of the fin 26 is illustrated. The fin 26 is shown attached to the member 134 with the pivot 136. A slot 144 substantially through a central plane between the front face 30 and the rear face 32 of the fin 26 is provided in an intermediate portion of the fin 26. A stationary or fixed rod 146, operably attached to the housing 138 in a rigid manner, such as with struts 147, as shown in FIG. 17, slides within the slot 144 as the fin 26 moves side-to-side from the action of the crankwheel 124. The rod 146 is stationary with respect to the housing 138. As the fin 26 moves side-to-side, the fin 26 will tend to flex, as generally shown in FIGS. 19 and 20. The flexing action of the fin 26 drives the watercraft 2 forward in the direction 24, as generally shown in FIG. 14.

The slot 144 and the fixed rod 146 provide the means for supporting the intermediate portion of the fin 26 as the end portion of the fin 26 attached to the 134 is reciprocated in a side-to-side, back-and-forth motion. It should be understood that the means may also be accomplished by a different structure disposed outside the fin 26 that provides the same function. For example, a rectangular frame that defines an opening disposed at the same distance from the housing 138 as the rod 146 and fixed relative to the housing 138, for example, with the struts 147, the opening being configured to allow the intermediate portion of the fin 26 to slide in and out of the opening, may be used.

The distance that the pin 128 traverses from side-to-side may be made smaller or larger by changing the diameter of the circular slot 132. A smaller diameter will result in a shorter side-to-side distance, while a larger diameter will increase the side-to-side distance. The position of the slot 144 and the rod 146 will either move closer to the pivot 136 with a smaller diameter of the slot 132 of farther away with a larger diameter. A small enough diameter of the slot 132 will cause smaller side-to-side motions from the neutral position shown in FIG. 18.

The crankwheel 124 is driven by the flexible shaft 38 connected to the shaft 126. A rigid shaft with appropriate universal joints for changing directions may also be used in place of the flexible shaft 38. The crankwheel 124 may also be driven directly by the rear wheel 36 of the bicycle 8.

Figure 22:
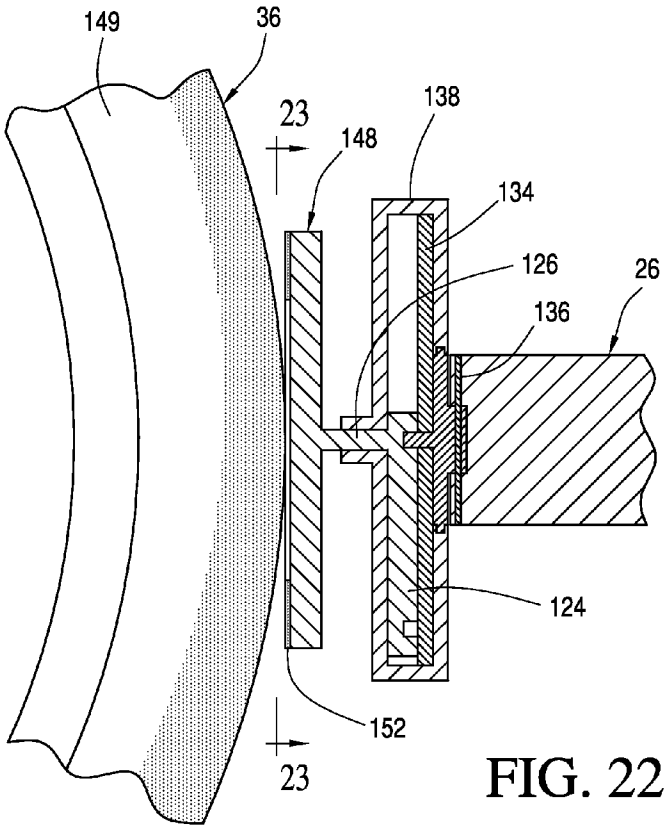
FIG. 22 is a cross-sectional view taken along line 22-22 in FIG. 21.
Figure 21:
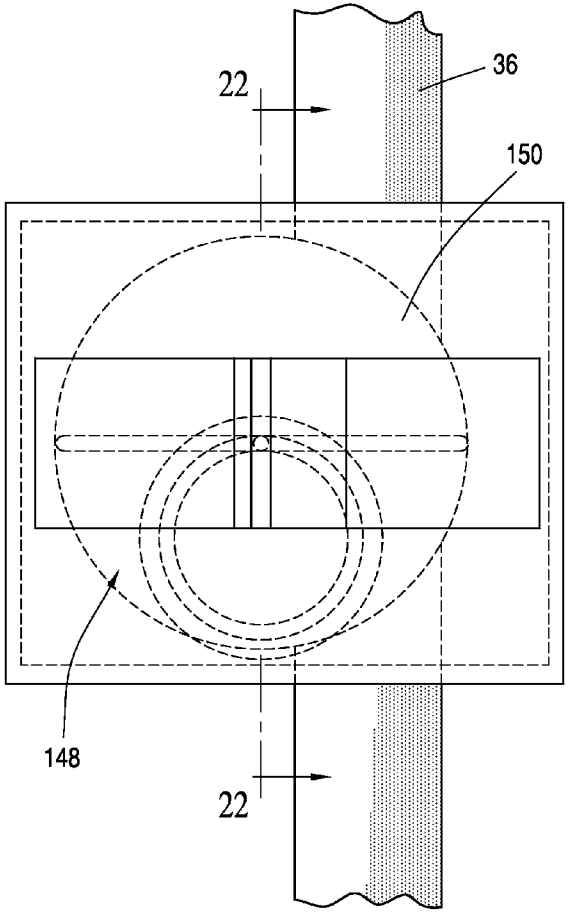
FIG. 21 is an elevational view of the rotary-to-linear motion converter shown in FIG. 16 with an added driven wheel in driving contact with the bicycle's rear tire.
Figure 23:
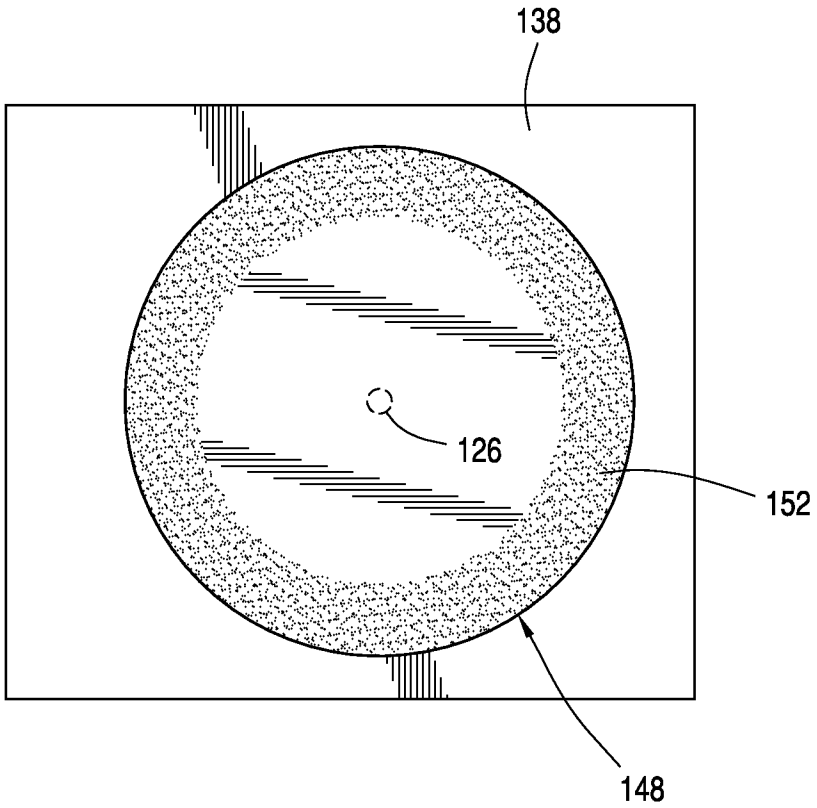
FIG. 23 is a cross-sectional view taken along line 23-23 in FIG. 22.

Referring to FIGS. 21 and 22, the converter 125 is driven by a driven wheel 148, which is drivingly engaged with the rubber tire 149 of the rear wheel 36. The driven wheel 148 has a circumferential side portion 150 that is engaged with the rear wheel 36. The driven wheel 148 is preferably disposed at about 90° with the plane of the rear wheel 36. The crankwheel 148 is attached to the shaft 126 so that turning the crankwheel 148 is effective to turn the shaft 126. The side portion 150 is advantageously coated with a frictional layer 152, such as a rubber layer or sand particles layer, to promote sufficient contact and lessen slippage between the driven wheel 148 and the rubber tire 149 of the rear wheel 36.

Although the crankwheel converter 125 shown in FIGS. 16-23 is shown with the pivoting attachment of the fin 26, it should be understood that the mechanism is also applicable for the rigidly, non-pivotingly attached fin 26 shown in FIGS. 1-15. Conversely, the pivotingly attached fin 26 shown in FIGS. 16-23 may also be used with the converter 34 or the converter 72.

It should be understood that the housing 138 shown in FIGS. 16-23 may be rotated 90° from the position shown to change the motion of the fin 26 from the side-to-side motion to an up-and-down motion, as generally shown in FIG. 11.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A watercraft for moving along a direction of movement on water, comprising:

a) a flexible fin with a front face and a rear face for placement in the water; and b) one end of said flexible fin is movable along a line in a reciprocating motion along a direction transverse to said front and rear faces and said direction of movement of said watercraft, causing an opposite free end of said flexible fin to flex back and forth in the water to propel said watercraft in said direction of movement.

2. The watercraft as in claim 1, and further comprising:

a) a rotary to linear motion converter having a rotary motion input and a translatory motion output; and b) said translatory motion output is operably attached to said one end of said flexible fin.

3. The watercraft as in claim 2, wherein:

a) said rotary motion input includes a shaft operably attached to a partial gear wheel;

b) said translatory motion output includes first and second rack gears disposed opposite each other in a housing;

c) said partial gear wheel is alternately engaged with said first and second rack gears such that said housing is driven in said reciprocating motion; and d) said one end of said flexible fin is operably attached to said housing.

4. The watercraft as in claim 3, wherein:
a) said one end of said flexible fin is pivotably attached to said housing with a pivot;
b) an intermediate portion of said flexible fin includes a slot substantially through a central plane between said front face and said rear face; and
c) a fixed rod disposed within said slot such that said flexible fin is slidable on said rod within said slot when said one end of said flexible fin reciprocates and pivots about said pivot when said one end of said flexible fin is cause to reciprocate.

5. The watercraft as in claim 2, wherein:
a) said rotary motion input includes a shaft operably attached to a crankwheel with a circumferential slot;
b) said translatory motion output includes a pin slidable on a longitudinal slot and disposed in said circumferential slot; and
c) a member attached to said pin, said member is slidable along a guide, said member moving in said reciprocation motion when said crankwheel is rotated.

6. The watercraft as in claim 5, wherein:
a) said shaft is driven by a wheel; and
b) said wheel is driven by a rear wheel of a bicycle.

7. The watercraft as in claim 3, wherein said housing is disposed horizontally such that said one end of said flexible fin moves horizontally.

8. The watercraft as in claim 3, wherein said housing is disposed vertically such that said one end of said flexible fin moves vertically.

9. The watercraft as in claim 3, and further comprising:
a) a bicycle operably attached to said watercraft, said bicycle including a driven rear wheel; and
b) said shaft is operably connected to said driven rear wheel.

10. The watercraft as in claim 9, wherein:
a) said bicycle includes a handle bar and a front wheel;
b) a vane operably attached to a said front wheel such that turning said handle bar left or right steers said watercraft left or right, respectively.

11. The watercraft as in claim 9, and further comprising a flexible shaft having one end operably connected to said shaft of said rotary motion input and another end of said flexible shaft operably connected to said driven rear wheel.

12. The watercraft as in claim 1, wherein said watercraft includes a pair of floats disposed side by side and spaced apart by a distance.

13. The watercraft as in claim 12, wherein said floats are inflatable.

14. The watercraft as in claim 1, wherein said flexible fin is tapered from said free end toward said one end.

15. The watercraft as in claim 14, wherein said flexible fin is tapered in thickness from said one end to said free end.

16. The watercraft as in claim 1, wherein said flexible fin is less flexible at said one end than at said free end.

17. The watercraft as in claim 1, wherein said front and rear faces are disposed substantially perpendicular to a horizontal plane.

18. The watercraft as in claim 1, wherein said front and rear faces are disposed substantially parallel to a horizontal plane.

19. A watercraft for moving along a direction of movement on water, comprising:
a) first and second flexible fins each with a front face and a rear face for placement in the water;
b) said first and second fins are movable along a line in opposite directions in a reciprocating motion along a direction transverse to said front and rear faces and said direction of movement of said watercraft, causing an opposite free end of each of said first and second fins to flex back and forth in the water to propel said watercraft in said direction of movement.

20. The watercraft as in claim 19, and further comprising:
a) a rotary to linear motion converter having a rotary motion input and a translatory motion output; and
b) said translatory motion output is operably attached to said one end of said flexible fin.

21. The watercraft as in claim 20, wherein:
a) said rotary motion input includes a crankshaft having first and second connecting rods;
b) said first and second connecting rods are operably connected to respective first and second pushrods; and
c) said first and second pushrods are operably attached to respective said first and second fins.

22. The watercraft as in claim 21, wherein:
a) said crankshaft is disposed in a housing; and
b) said first and second pushrods extend horizontally outside of said housing.

23. The watercraft as in claim 21, wherein:
a) said crankshaft is disposed in a housing; and
b) said first and second pushrods extend vertically outside of said housing.

24. The watercraft as in claim 1, wherein said watercraft is a boat.

* * * * *